US007425002B2

(12) United States Patent
Goss

(10) Patent No.: US 7,425,002 B2
(45) Date of Patent: Sep. 16, 2008

(54) APPARATUS AND METHOD FOR GENERATING A GRAPHICAL TRANSFORMATION OF A LOTTERY INPUT NUMBER

(75) Inventor: Chris Goss, Winchester (GB)

(73) Assignee: Randomaker Ltd., London (GB)

( * ) Notice: Subject to any disclaimer, the term of this patent is extended or adjusted under 35 U.S.C. 154(b) by 259 days.

(21) Appl. No.: 11/334,155

(22) Filed: Jan. 17, 2006

(65) Prior Publication Data

US 2006/0189368 A1 Aug. 24, 2006

Related U.S. Application Data

(60) Provisional application No. 60/655,737, filed on Feb. 22, 2005.

(51) Int. Cl.
*A63B 71/00* (2006.01)

(52) U.S. Cl. ..... 273/144 B

(58) Field of Classification Search ..... 273/144, 273/144 B; 463/42

See application file for complete search history.

(56) References Cited

U.S. PATENT DOCUMENTS 4,724,307 A * 2/1988 Dutton et al. ..... 235/455
4,984,796 A * 1/1991 Peacock ..... 273/142 E
5,048,833 A * 9/1991 Lamle ..... 463/27
5,909,875 A * 6/1999 Weingardt ..... 273/269
6,152,448 A * 11/2000 Cudlipp ..... 273/144 R
6,183,361 B1 * 2/2001 Cummings et al. ..... 463/18
6,322,071 B1 * 11/2001 Chaaban ..... 273/138.4
6,478,677 B1 * 11/2002 Moody ..... 463/18
6,702,669 B2 * 3/2004 Moody ..... 463/18
6,763,094 B2 7/2004 Conn et al. ..... 379/91.01
6,783,456 B2 * 8/2004 White ..... 463/18
2001/0013680 A1 * 8/2001 Chaaban ..... 273/121 B
2002/0119815 A1 * 8/2002 Lyons ..... 463/16
2002/0174444 A1 * 11/2002 Gatto et al. ..... 725/133
2004/0259631 A1 * 12/2004 Katz et al. ..... 463/25
2006/0025222 A1 * 2/2006 Sekine ..... 463/42

* cited by examiner

*Primary Examiner*—Eugene Kim
*Assistant Examiner*—Dolores R. Collins
(74) *Attorney, Agent, or Firm*—BainwoodHuang

(57) ABSTRACT

One embodiment of the invention provides apparatus comprising an input for receiving a lottery number, K, from a lottery draw or other source of unpredictable numbers, and an output for presenting a graphical selector comprising N options. The graphical selector steps in sequence through said N options in accordance with the received lottery number K to select an option. The output can be incorporated into a broadcast television signal as part of a lottery program, and used to drive other material in the program, as well as providing an application for other platforms, such as mobile telephones and the Internet.

4 Claims, 14 Drawing Sheets
(2 of 14 Drawing Sheet(s) Filed in Color)

APPARATUS AND METHOD FOR GENERATING A GRAPHICAL TRANSFORMATION OF A LOTTERY INPUT NUMBER

RELATED APPLICATION

This application hereby claims priority under 35 U.S.C. section 119 to U.S. Provisional Patent Application No. 60/655,737 filed on 22 Feb. 2005, entitled "Apparatus and Method for Generating a Graphic for the Transformation of an Input Number," by inventor Chris Goulven Goss.

FIELD OF THE INVENTION

The present invention relates to a method and apparatus for generating a graphical transformation of a lottery input number, such as might be used in a television broadcast, in an application over the Internet or a mobile telephone network, and such-like.

BACKGROUND OF THE INVENTION

Many states, countries, and other organisations run lottery competitions. In a typical lottery competition, a player chooses K different numbers from N possibilities, normally represented by the integers from 1 to N. The values of K and N are determined by the organisers to provide appropriate odds for the lottery, given the expected number of participants. For example, in the United Kingdom national lottery (Lotto), N=49 and K=6 (excluding the Bonus ball). Each draw of the lottery selects K numbers. In many cases, the draw is implemented by placing N balls in a container, and special apparatus is used to select K balls from the container. If a player has selected K numbers that match the K numbers drawn from the lottery machine, this corresponds to the jackpot prize, while if a player matches fewer numbers, then a smaller prize may be payable. For example, in the United Kingdom Lotto draw, a prize is awarded to anyone who matches three or more of the numbers drawn, with the prizes increasing in size as more numbers are matched.

Lottery competitions usually involve significant amounts of money, and are subject to strict regulation to ensure complete fairness. Often there is an independent scrutineer to oversee the lottery draw. In some implementations, the K balls are drawn one after another from a container in quick succession.

Many lottery draws are televised, and may attract a substantial audience in view of the large number of players involved in the lottery. It is highly desirable for program makers to retain the large lottery audience for as long as possible, for example to maximise advertising revenues. However, this is difficult if the duration of the lottery program is based on the duration of the draw itself, which may be no more than a couple of minutes or less. In addition, as the lottery results become increasingly available through other media, for example on the Internet, there is a tendency for lottery participants not to watch the television show at all.

One approach to maintain or regain audience is to expand or enhance the lottery show with material substantially unrelated to the lottery itself. However, since there is no real link from an audience perspective between the lottery draw and the rest of the program, a significant proportion of the audience may decide to watch only the lottery draw portion of the program and to ignore the rest of the material (or perhaps vice versa).

Another possibility is to try to extend the impact of the lottery draw into the remainder of program, by somehow making the lottery draw an integral part of the program. In this case, an audience tuning in specifically for the lottery draw is more likely to stay with the program, since there is no abrupt transition to extraneous material, but rather a more coherent flow to the program. However, there are regulations to protect the impartiality of the lottery, and these generally imply that the draw must be performed in a standalone (and hence easier to verify) environment. This makes it more difficult for television producers to achieve a natural, flexible, and transparent integration of any additional program material with the lottery draw itself.

A further concern for lottery providers is that such draws have often been running for many years, and their participation rates are either stable or in decline. Accordingly, lottery providers are looking to stimulate renewed public interest in the draws. In addition, lottery providers are also keen to create and exploit any opportunities for additional revenue, ancillary to the main lottery draw itself.

SUMMARY OF THE INVENTION

Accordingly, one embodiment of the invention provides apparatus comprising an input for receiving a non-predictable input number, K, which comprises a lottery number, and an output for presenting a graphical selector comprising N options. The graphical selector steps in sequence through the N options in accordance with the received number K to select one of the N options, thereby transforming the non-predictable input number K into a selection of an output option.

Such an approach provides a powerful and flexible mechanism for extending a primary lottery draw or other source of numbers by determining a set of one or more output options that can be used to drive additional games or material. The output options may represent secondary games, such as secondary lottery games and television games for programming associated with the lottery. The secondary lottery games may include second chance games, where players use the same ticket or entry from a primary lottery game to participate in a second chance game.

Note that the apparatus is detached from the lottery draw machine itself, and so does not impact the reliable and fair operation of the main lottery. In addition, the graphic to select the new set of options is both random and completely transparent, and hence can be seen to be fair (this is very important for anything formally associated with a lottery). It is also visually appealing, for example for inclusion within a television show, and by implementing the option selection as a real-time, animated graphic, the result is readily accessible to all participants. The format of the resulting selection is very flexible, and can be varied greatly according to the particular needs of any given application and environment (e.g. lottery draw, studio setting, games over a mobile network, interactive games, etc).

The approach can lead to increased revenues for lottery operators, whether through secondary games, television programming, or some other appropriate mechanism. The approach may also help to increase sales of the primary lottery game, whether by raising profile, linkage to a secondary game or competition, and so on. At the same time, there is minimal extra cost for lottery operators, since little or no additional airtime is needed (in respect of any secondary lottery game), and no extra lottery ball draw machines are required.

In one implementation, N is less than the maximum possible value of K, and the selector selects one of said N options in accordance with the value of KmoduloN. For example, if there are N=5 options, labelled as 1 through 5, and the value of K is 7, then KmoduloN=2. This value then determines the selected option (allowing for where we start in the sequence). The modulo function implies a cyclic sequence through the options. In other embodiments, a different form of repeat pattern may be used—for example stepping from 1 to 5, then from 5 to 1, then from 1 to 5 again, and so on.

In general, a succession of numbers (e.g. representing a partial or complete lottery draw) is received at the input, and the selector determines an option for each of the received numbers. In some implementations, an option selected by a number during the succession of numbers is no longer available for selection by a subsequent number in the succession. Such an already selected option may be displayed thereafter in a visually distinct manner. In some embodiments, such an already selected option may be included in the count as the selector steps round the options, while in other embodiments, the counting may skip over such an already selected option. In the latter case, the already selected option may be omitted from the selector entirely if so desired. However, in other embodiments, the same option may be selectable more than once within the same succession of numbers.

The starting position for the graphical selector in the sequence of N options may be determined by the location of the graphical selector after the preceding number in the succession. For example, the new starting position may correspond to the previously selected output option. Alternatively, the starting position may be (re)set to a fixed location within the selector for each input number.

In some implementations, the positions or order of the N options within the selector may be randomised prior to receipt of the input number, thereby ensuring that each of the different options has the same likelihood of being selected. An alternative approach would be to randomise the starting position itself within the N options prior to selecting an output option. If a succession of numbers is being received, such randomisation of the option ordering and/or the starting position may be performed just once at the beginning of the succession of numbers, or repeatedly, before each individual number in the succession of numbers.

Multiple graphical selectors may be provided to operate in parallel with one another. This then allows multiple output options to be selected for each individual input number.

In one implementation, the output provides an animated graphic for a television signal. The output could also transmit over other forms of communication network, such as the Internet, mobile telephones, a network television monitor system, and so on. One possibility is for an applet or similar functionality to be downloaded onto a mobile phone or other form of client system to produce the graphic. Note that the graphical animation will generally be performed in real-time, as the succession of lottery numbers is drawn one after another. If appropriate, the numbers may be transmitted to a client system that is generating the graphic locally.

Another embodiment of the invention provides a method of generating a computerised graphic comprising receiving a non-predictable number, K, which represents a lottery number; and presenting a graphical selector comprising N options. The graphical selector steps in sequence through the N options in accordance with the received number K to select one of the N options, thereby transforming the non-predictable input number K into a selection of an output option. This method may benefit from the same features as described above in relation to the apparatus embodiments.

Another embodiment of the invention provides a computer program and a computer program product comprising machine instructions for implementing a method such as described above. The computer program product may be provided as a set of instructions recorded onto a physical medium, such as a CD, a DVD, and so on, or encoded into a transmission medium on a wireless or wired network such as the Internet. In either case, such instructions can then be loaded into a computer system for execution. It will be appreciated that the computer program product, along with the method embodiment, may utilise and benefit from the same particular features as described above in relation to the apparatus embodiment.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Various embodiments of the invention will now be described in detail by way of example only with reference to the following drawings.

DETAILED DESCRIPTION

Figure 1A:
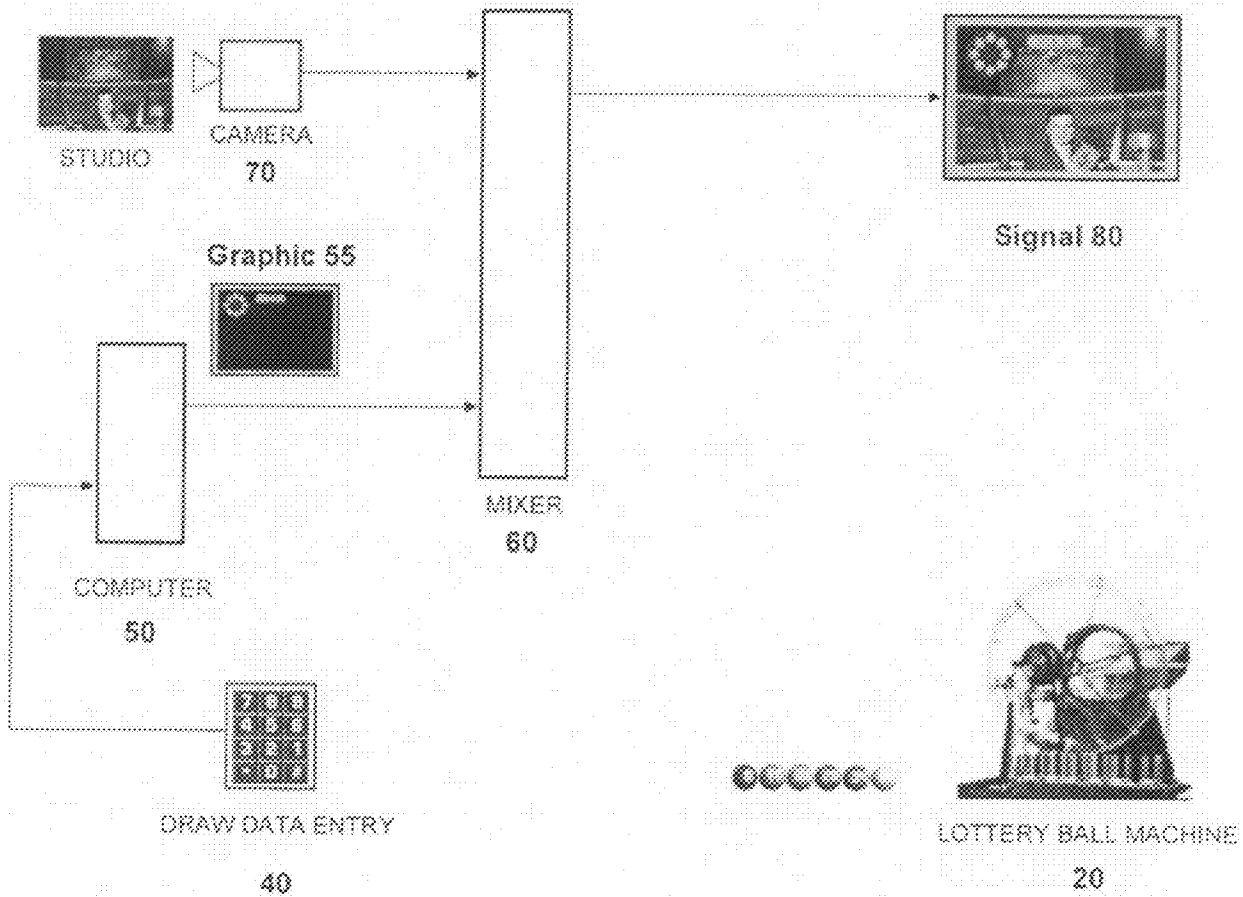
FIG. 1A illustrates apparatus for generating a television signal in accordance with one embodiment of the invention.

FIG. 1A illustrates apparatus for generating a television signal in accordance with one embodiment of the invention. A lottery machine 20 generates a sequence of numbered balls. The numbers from the draw are then fed into a data entry station 40, which may be a keyboard or some other suitable device operated by someone who is watching the output from the lottery machine 20. In another embodiment, the data entry station may be implemented using an automatic number recognition system based on a camera that monitors the output from the lottery machine 20.

The draw entry data is passed to a computer 50, which implements a data manipulation procedure to produce an output graphic 55, as described in more detail below. The graphic is generally produced in real-time, and is animated in response to the data entered into the draw entry unit 40. The output graphic 55 is then passed to a mixer 60, where it is combined with a studio shot from camera 70, to produce the broadcast signal 80.

In some implementations, a camera may also be provided to monitor the lottery ball machine 20, and the output from such a camera may also be provided to mixer 60 for combination into broadcast signal 80. Another possibility is that the graphic 55 generated by computer 50 may include a representation of the output from the lottery ball machine 20 (as entered into the computer via the draw data entry unit 40). In other embodiments, the studio image from camera 70 may be omitted from the broadcast signal 80, depending upon the particular visual and production requirements of the television program.

Figure 1B:
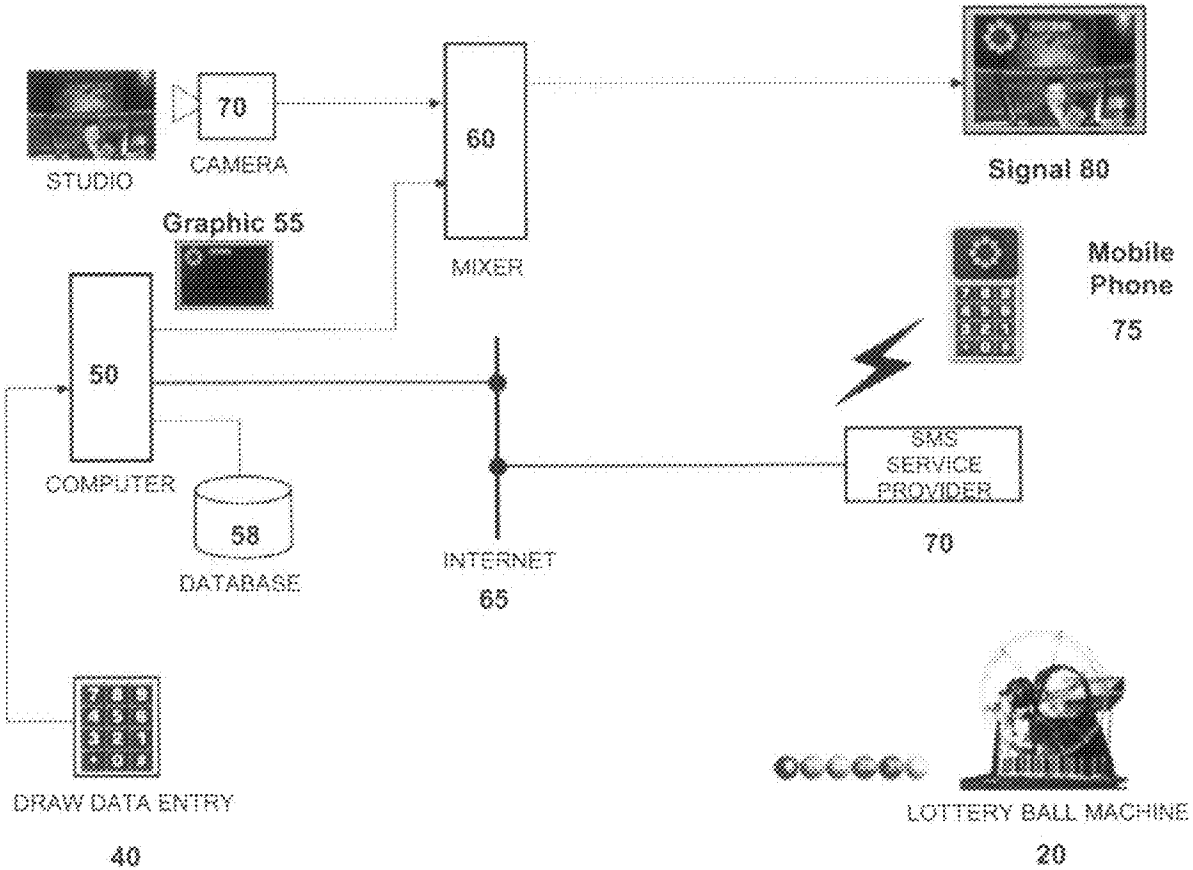
FIG. 1B illustrates apparatus for generating a television signal in accordance with another embodiment of the invention.

FIG. 1B illustrates apparatus generally similar to that of FIG. 1A, but which also supports user input. In particular, computer 50 is provided with database 58, and is linked via the Internet 65 to a simple messaging service (SMS) service provider 70. For various activities, SMS service provider may receive input from mobile (cellular) phones for storage into database 58. Note that such messages may provide a source of revenue for the lottery program maker (or other relevant party). It will be appreciated that in other implementations, user input may be supported via one or more alternative (or additional) mechanisms, such as using an interactive television service or a personal computer attached to the Internet, and/or supporting forms of input from mobile telephones other than SMS. The input channel(s) may correspond directly to the output channel(s)—e.g. output is via a web page, and input is made onto that page—or they may be different—e.g. output via television and input via mobile telephone.

Thus although FIGS. 1A and 1B illustrate one distribution mechanism for the output from computer 50, namely as television signal 80, it will be appreciated that other output mechanisms are possible, for example over a mobile telephone network or the Internet. One possibility is that the output is downloaded as a form of animation to run on a client computer or a mobile telephone. Such output formats may supplement or replace the output as television signal 80, and are described in more detail below.

Figure 2A:
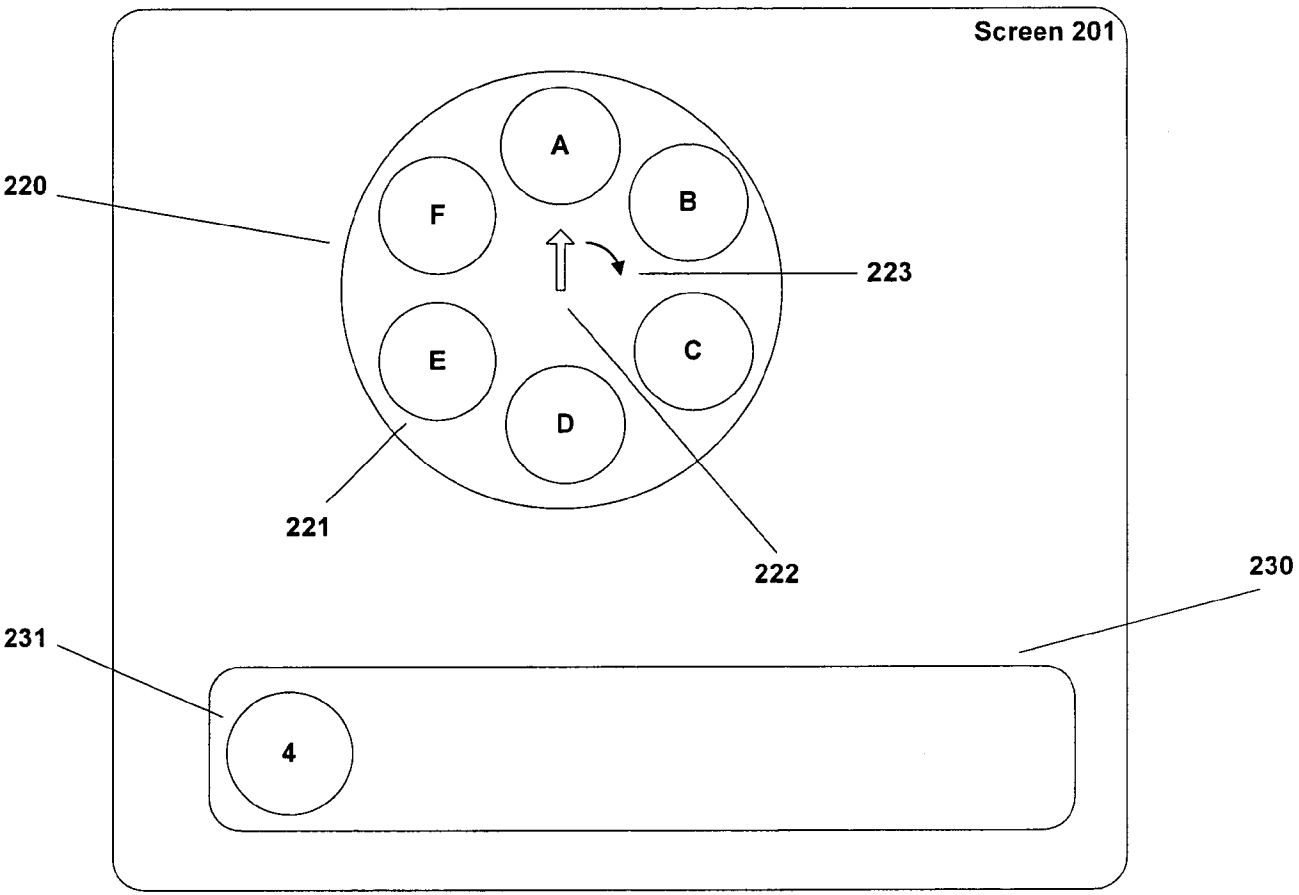
FIGS. 2A-2D show a sequence of screen images during a lottery draw in accordance with one embodiment of the invention.

FIG. 2A illustrates the on-screen appearance of television signal 80 in accordance with one embodiment of the invention, and in particular, the graphics component 55 generated as output from computer 50. Note that a similar screen might also be provided over a mobile telephone network, the Internet, or any other appropriate distribution network. Screen 201 includes two main graphics components, namely graphic or cyclic selector 220 and number block 230. Number block 230 shows the lottery numbers that have been drawn so far (in FIG. 2A, it is assumed that ball number 4 has so far been drawn from the lottery machine). Block 230 may be provided by a live camera feed from the lottery machine itself, showing the sequence of balls 231 as they are selected from the container, or may be provided as a computer-generated graphic for provision onto screen 201. Note that screen 201 may also depict other items, such as the audience at the lottery show, the host of the show, or a contestant for some game linked to the lottery (depending upon the amount of space remaining within screen 201).

In the embodiment of FIG. 2A, the cyclic selector 220 is represented by a circular device. Evenly distributed around the perimeter of the cyclic selector are a number of options 221. Each option is represented by a ball 221, and in FIG. 2A the various options in the cyclic selector are schematically labelled by the letters A, B, C, D, E and F. The inner portion of the cyclic selector 220 is occupied by a selection arrow or pointer 222, which rotates in the direction indicated by arrow 223. As selection arrow 222 rotates, it points at each option ball 221 in turn.

The amount that selection arrow 222 is rotated depends upon the number on the lottery ball 231 that has just been drawn. In particular, the selection arrow 222 is rotated by the number of spaces or units indicated by the most recently selected lottery ball 231, as shown in number block 230. In the example of FIG. 2A, this is 4, and so the selection arrow 222 rotates 4 units around the cyclic selector.

For convenience we assume that the selection arrow 222 initially points upwards to the option ball denoted as "A" in FIG. 2A, and that the rotation is in the clockwise direction. Accordingly, the selection arrow 222 rotates 4 units around cyclic selector 220 in response to the arrival of lottery ball 231, thereby arriving at option E. This brings us to the situation depicted in FIG. 2B, where arrow 222 now points to ball E. Note that option ball E has been visually modified in FIG. 2B (by hatching) in response to this selection, to provide a clear visual indication of its selection (or elimination).

Figure 2B:
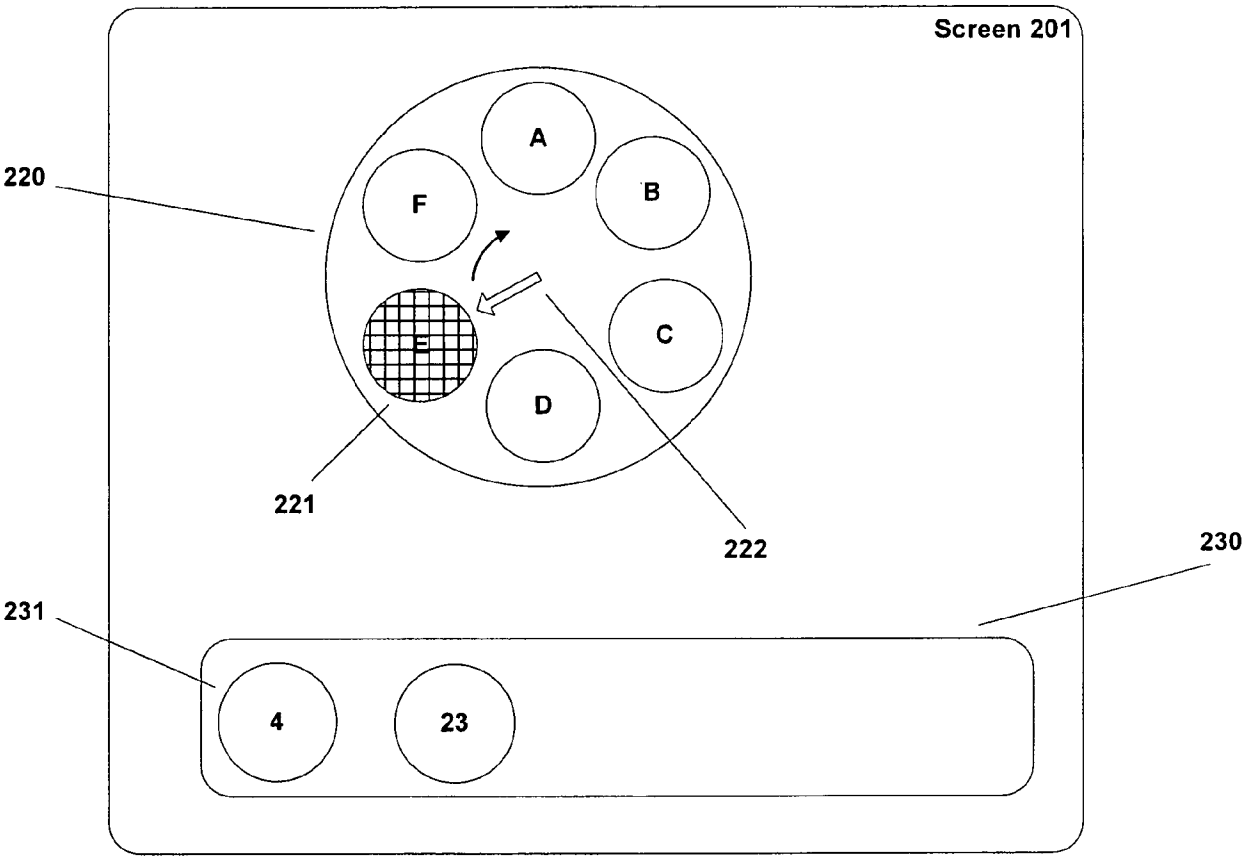

We now assume that a further lottery ball 231 is drawn from the lottery machine, for example the lottery ball 23, as also shown in number block 230 of FIG. 2B. In response to this ball, the selection arrow 222 is again rotated in the clockwise direction, this time by 23 units. However, we now ignore option ball E in the counting, since it has been eliminated by its previous selection. It will be appreciated that since the number on the drawn lottery ball (23) is greater than the number of unselected option balls remaining in the cyclic selector (5), the rotation will loop around the cyclic selector more than once. In fact, each complete rotation of selection arrow 222 around the remaining balls of cyclic selector 220 corresponds to five units, so that a rotation of twenty-three units takes us to option ball B (equal to five complete rotations of the cyclic selector, plus another three units). Note that in this rotation we started counting from the option ball immediately after the option ball that was selected by the previous lottery ball (i.e. from option ball F), rather than returning to option ball A to start.

Figure 2C:
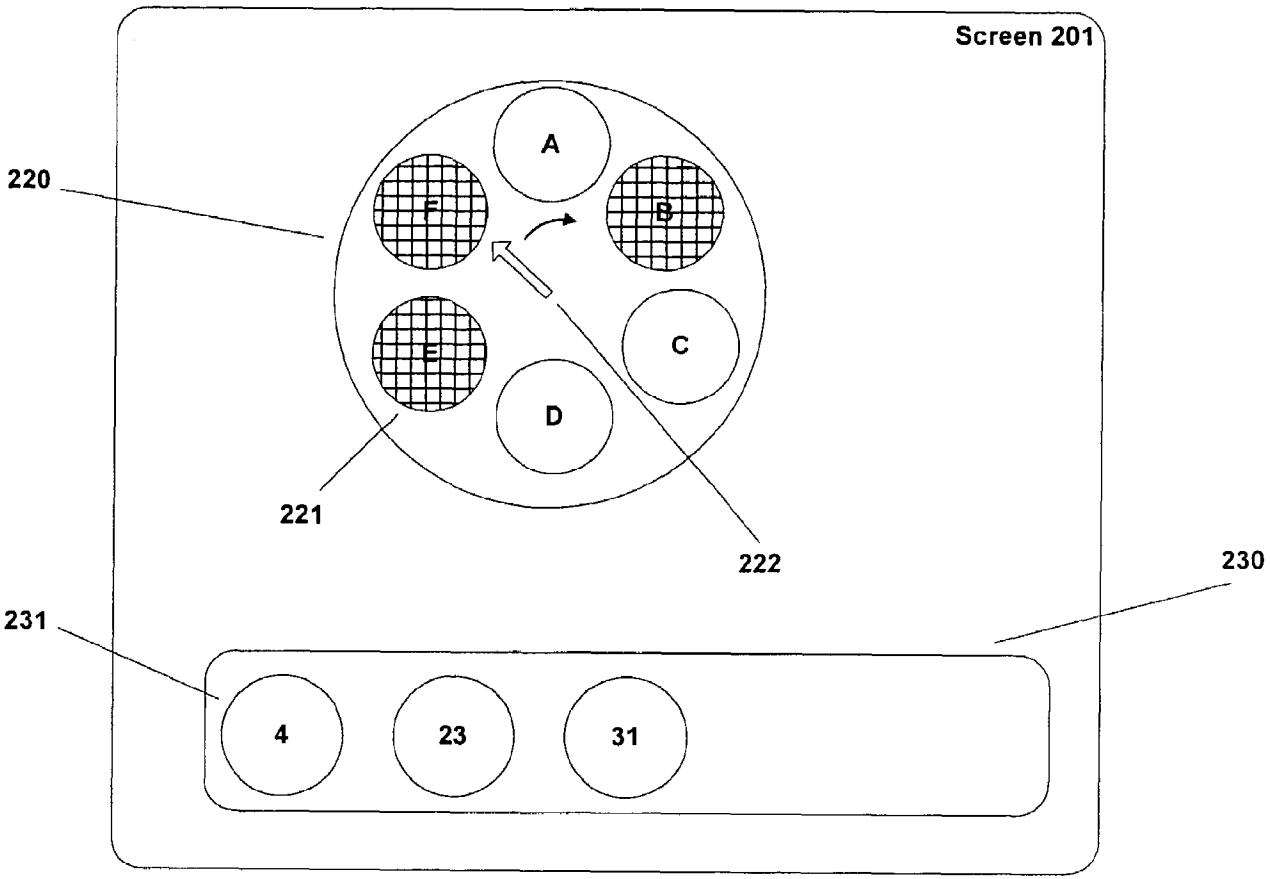

FIG. 2C illustrates the situation after three lottery balls have been drawn, namely lottery balls 4 and 23 as already discussed, followed by lottery ball 31. As previously described, the rotations for lottery balls 4 and 23 eliminated option balls E and B respectively from the cyclic selector 220. In addition, the rotation for lottery ball 31 eliminates option ball F, which is also shown as hatched in FIG. 2C.

Figure 2D:
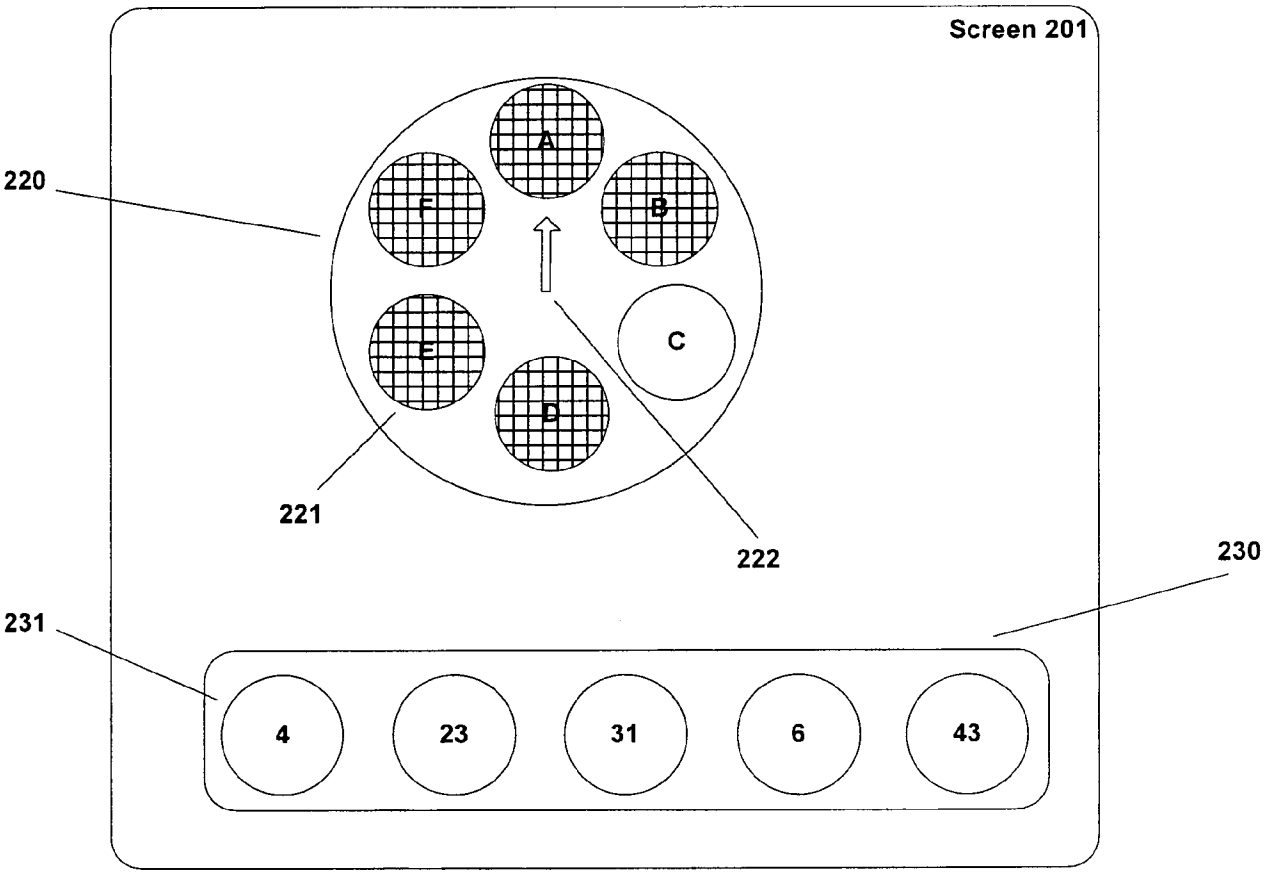

FIG. 2D illustrates the situation after the fourth and fifth lottery balls have been drawn, which in the present example are assumed to be the final two lottery balls 231. The cyclic selector 220 has implemented the rotation for the fourth lottery ball (6), which progressed the selector arrow 222 from option ball F to option ball D, and also for the last lottery ball (43), which progressed the selection arrow 222 from option ball D to option ball A (after many complete "circuits" of the two remaining option balls). Accordingly, option balls D and A are also shown as hatched in FIG. 2D.

The outcome of the above selection is that all the option balls apart from option ball C have been eliminated, which therefore leaves option ball C as the single outstanding selection at the end of the lottery draw. In other words, the five lottery balls shown in number block 230 have been used to drive a randomised selection process that has eliminated all the options from the cyclic selector 220 apart from option ball C.

The cyclic selection process depicted in FIGS. 2A-2D provides a visually interesting and appealing mechanism for converting a sequence of lottery ball numbers into a single selection that is generally more appropriate for use in further television programming. The selection is derived in a highly transparent manner, and so is readily subject to confirmation by the viewers and any necessary independent verification. In addition, the selection is very flexible and open to many different configurations, e.g. as to the number and type of selections (or remaining options).

For example, in FIGS. 2A-2D, the initial number of option balls was one greater than the number of lottery balls selected in the draw. Consequently, after elimination of one option ball by each selected lottery ball, there was a single remaining ball (ball C). However, in other implementations, the number of option balls could be increased, so that more than one option ball remains after elimination of one option ball by each selected lottery ball. For example, if there are eight option balls and five lottery balls are selected for a lottery draw, then after elimination three option balls will remain. It will be appreciated that an appropriate number of option balls can be provided to result in any desired number of remaining balls (for a given number of lottery balls).

Such an arrangement can be used to drive a secondary game derived from the main (primary) lottery. For example, participants might select three numbers, which might be entered via one of the input mechanisms discussed above in relation to FIG. 1B. A participant is regarded as a winner if his or her three selections correspond to three of the remaining option balls in the cyclic selector (where there may be three or more remaining option balls, depending upon configuration). Alternatively, the numbers to be matched may represent those actually selected by the cyclic selector (rather than the selected options being eliminated).

An important benefit of the cyclic selector 220 is that it gives very great flexibility over the format of any secondary game, such as regards the number of numbers to be selected by a participant, and the number of numbers that have to be matched in order to win. This is achieved independently of the number of numbers obtained from the main lottery draw (which is normally fixed in advance).

For example, one secondary lottery game for a lottery draw producing four lottery balls might involve three cyclic selectors 220, all potentially displayed on one screen. The first lottery ball is then used to rotate the selector arrow (or conversely, to rotate the numbers themselves) for the first cyclic selector to a starting point. The second lottery ball is then used to make a further rotation to select an option, as discussed above with reference to FIGS. 2A-2D. The value of the second lottery ball is also used to determine the starting position of the second cyclic selector, with the selected output from the second cyclic selector being determined by the third lottery ball (which also determines the starting position of the third cyclic selector). The output from the third cyclic selector is then determined by the fourth and final lottery ball. A winner might then be a participant who has selected three numbers corresponding to the outputs from the three cyclic selectors (from three or potentially more choices). The selection might be made by any appropriate mechanism, such as by buying a ticket at a lottery draw kiosk, by telephoning in the chosen numbers, etc. It will be appreciated that in other embodiments, the number of cyclic selectors involved need not be three, but can be varied according to the particular needs of the application.

In the above example, the initial rotation of each cyclic selector prior to actually selecting an output from that selector with a subsequent lottery ball is done to eliminate any bias. Thus if the initial number of option balls 221 is an exact divisor (i.e. a factor) of the total number of lottery balls, then there is no bias in the cyclic selector 220 (assuming that the lottery draw itself is truly random). For example, if the lottery ball numbers range from 1 to 48, and there are six option balls (as shown in FIGS. 2A to 2D), then each option ball will correspond to 8 lottery ball numbers and so be equally likely to occur, irrespective of the starting position of selection arrow 222. Consequently, it is often possible to design a selector to remove any bias.

On the other hand, if there were 49 lottery balls in the draw (and still 6 option balls), there would be a slight bias in favour of eliminating the option ball corresponding to the starting position of selection arrow 222, since this option would correspond to one additional lottery ball value (49) compared to all the other options. However, this slight bias is readily predictable, and can be overcome by initially selecting a random start position for the selection arrow 222 within the cyclic selector (rather than necessarily starting at option ball A). One possibility is to randomise the initial order of the option balls 221 within the cyclic selector, so that instead of having ABCDEF, the options balls might have the order CAFEDB (for example). This randomisation may be performed once, at the start of a succession of input numbers, or alternatively before each successive input number.

In other implementations, the slight bias in selection of the first option ball might be acceptable, if it does not impact the overall fairness of the event. For example, if the selector were used to discriminate various prize levels of a game (other than the lottery itself), and there was a slight bias in favour of the higher prize levels, this might be considered as acceptable.

Although the various options in the cyclic selector are shown as individual letters in the example of FIGS. 2A-2D, it will be appreciated that the options could correspond to words, numbers, colours, or any other appropriate categories for use in a television show. For example, each option A, B, C, D, E and F, might be assigned to one of six contestants, and it is the selected contestant (corresponding to option C in the example of FIGS. 2A-2D) that goes on to play a game as a result of the lottery draw. In this approach, the optional balls may be formed from photographs of contestants, perhaps sent in by email or by mobile telephone. Another possibility is that the selection of ball C corresponds to a particular game or task that a contestant has to perform. It will be appreciated that this sort of approach achieves a natural and very flexible integration between the lottery draw and the remaining material in the lottery television show.

Figure 3A:
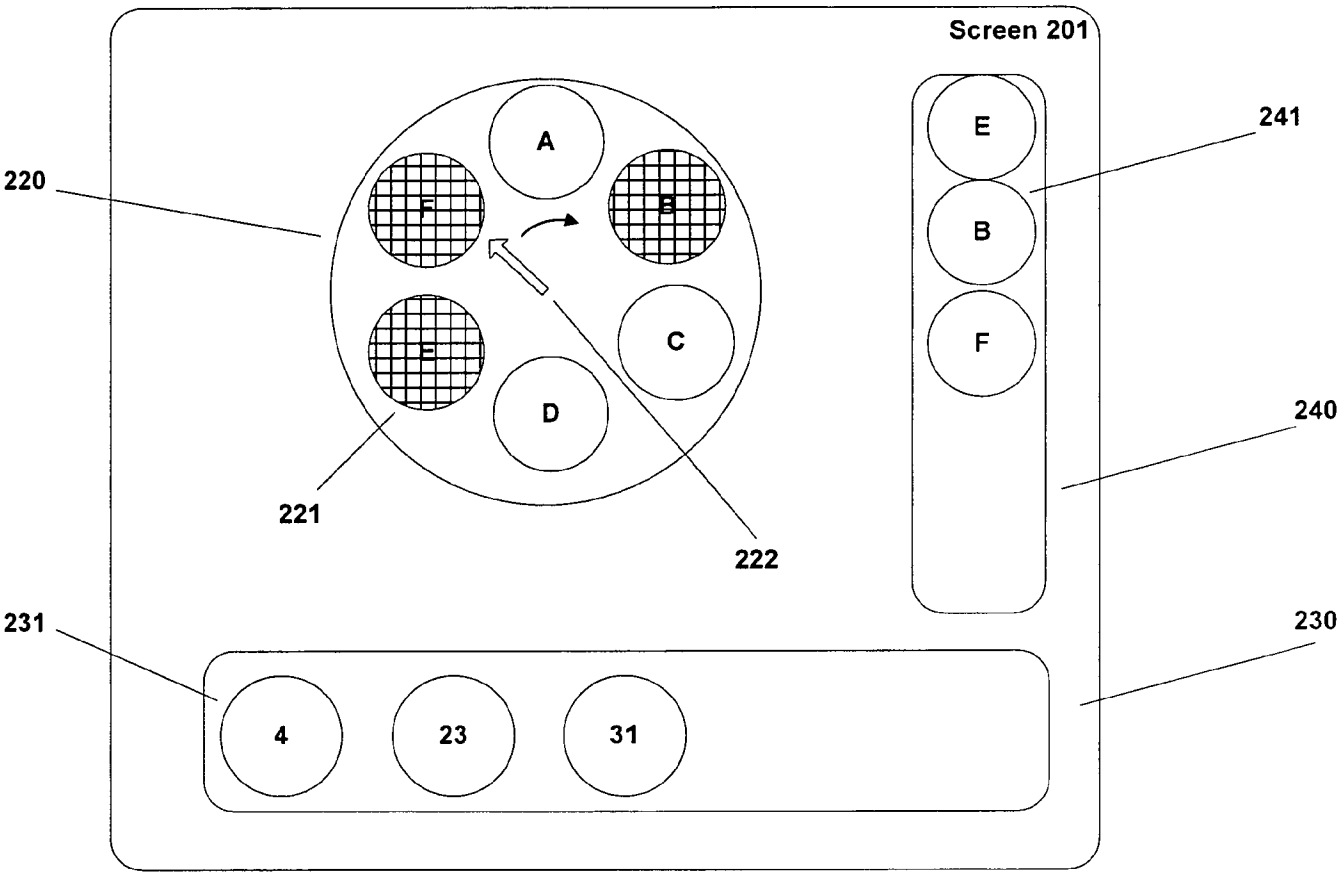
FIG. 3A shows a screen image during a lottery draw in accordance with another embodiment of the invention.
Figure 3B:
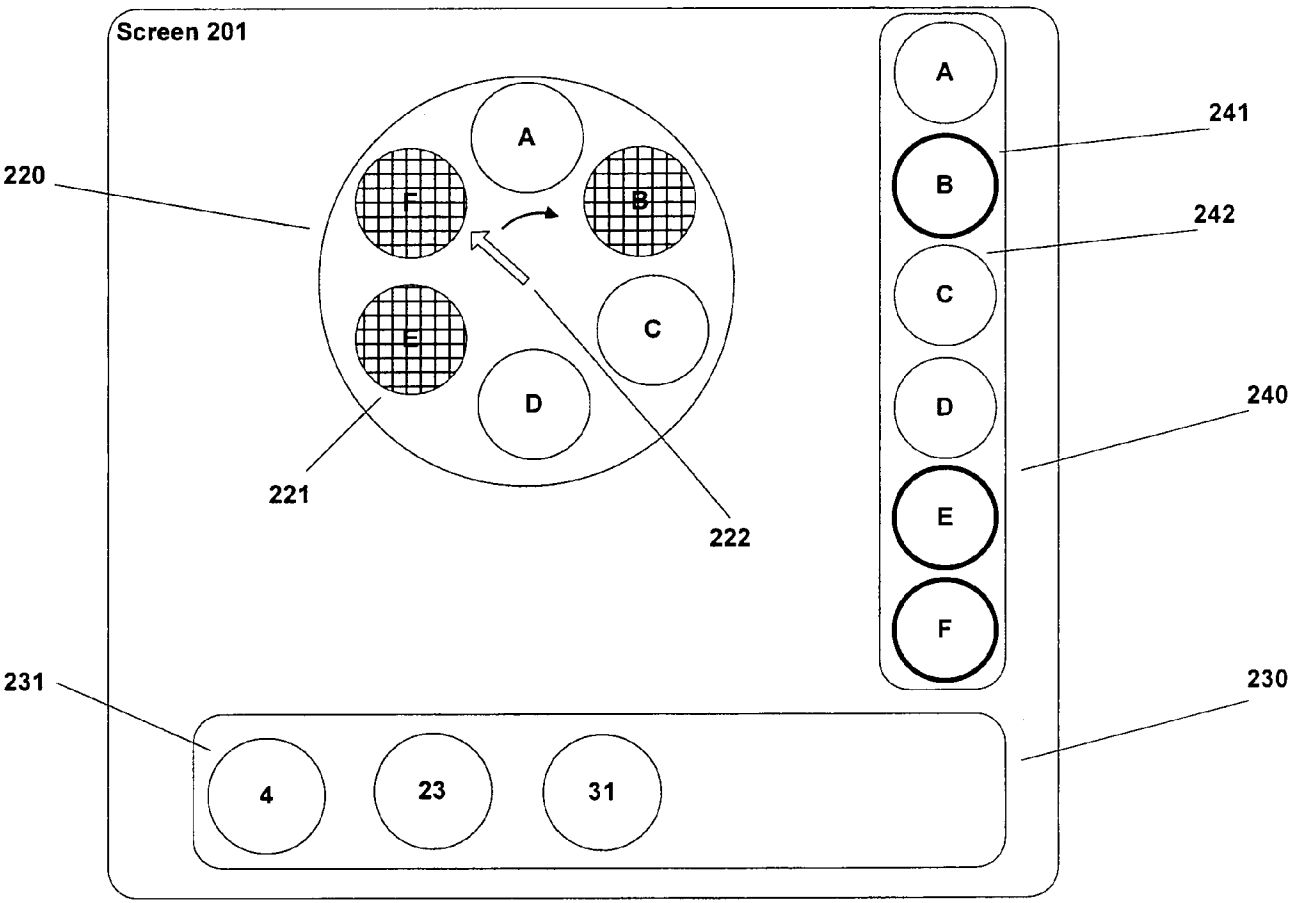
FIG. 3B shows a screen image during a lottery draw in accordance with a modification of the embodiment of FIG. 3A.

FIGS. 3A and 3B show a modification on the selection process of FIGS. 2A-2D. Note that in these embodiments, the operation of the cyclic selector 220 itself is the same as described with reference to FIGS. 2A-2D. However, as option balls are "eliminated" from the cyclic selector, they appear instead in a separate accumulation block 240 of the screen. Thus the balls 241 shown in accumulation block 240 (balls E, B and F) correspond to those option balls shown as hatched in the cyclic selector, and also reflect the sequence of lottery balls 231 (i.e. 4, 23, 31).

It will be appreciated that the embodiment of FIG. 3A leads to an accumulation of selected options. For example, with the same sequence of balls as in FIGS. 2A-2D, accumulation block 240 would end up containing the options E, B, F, D, A. This set of options can be used, for example, to determine multiple contestants to participate in the remainder of a game show associated with the lottery program, or perhaps to select tasks to be performed by various contestants (in which case the order of selection may be important). As previously mentioned, the number of option balls 221 may be more than one greater than the number of lottery balls drawn 231, depending upon the proportion of contestants (or tasks) that it is desired to eliminate at this stage.

Another possibility for the approach of FIG. 3A is that each ball 241 represents a particular letter, and the contestant has to think of a word containing the letters accumulated in block 240. A further possibility is that each ball 241 in accumulation block 240 represents a single digit number, and the television audience is requested to phone in if the sequence of numbers is contained in their phone number or in the final digits of the serial number of their lottery ticket, perhaps to win a prize. The skilled person will be able to think of many further applications for the selection procedure of FIG. 3A.

In one particular implementation of a secondary lottery game, six graphical selectors are provided, each with output options in a randomised order representing the digits 0 through 9. Six input numbers received from a primary lottery draw are fed to respective selectors to produce a corresponding output option. A contestant then has to match a certain number of the six output options against the digits in the serial number of their main lottery ticket.

FIG. 3B represents a modification on the approach of FIG. 3A, although the general selection strategy is the same. However, accumulation block 240 is now used to present all possible options from the cyclic selector 220. Accordingly, as the cyclic selector picks individual options 221, the representations of these options in block 240 are modified so as to be visually distinguished from the remaining options in block 240. FIG. 3B illustrates three highlighted options 241 in block 240, namely options B, E and F (corresponding to the three options selected in FIG. 3A). In contrast, the balls 242 that have not been selected so far (namely balls A, C, and D) are not shown as highlighted in accumulation block 240.

It will be appreciated that a similar representation to that of FIG. 3B may also be employed with the elimination technique of FIGS. 2A to 2D. In this case, all the balls in accumulation block 240 may start off as highlighted, but then lose their highlighting once the corresponding option has been eliminated by the cyclic selector 220. In addition, the approach of FIG. 3B could be implemented directly within cyclic selector 220 itself (which would therefore allow accumulation block 240 to be omitted). For example, a first colour might be used to represent those options that had not yet been selected/accumulated (i.e. those shown as options 242 in FIG. 3B), while a second colour might be used to represent those options that had already been selected/accumulated (i.e. those shown in FIG. 3B as hatched within cyclic selector 220, and highlighted with accumulation block 240).

Figure 3C:
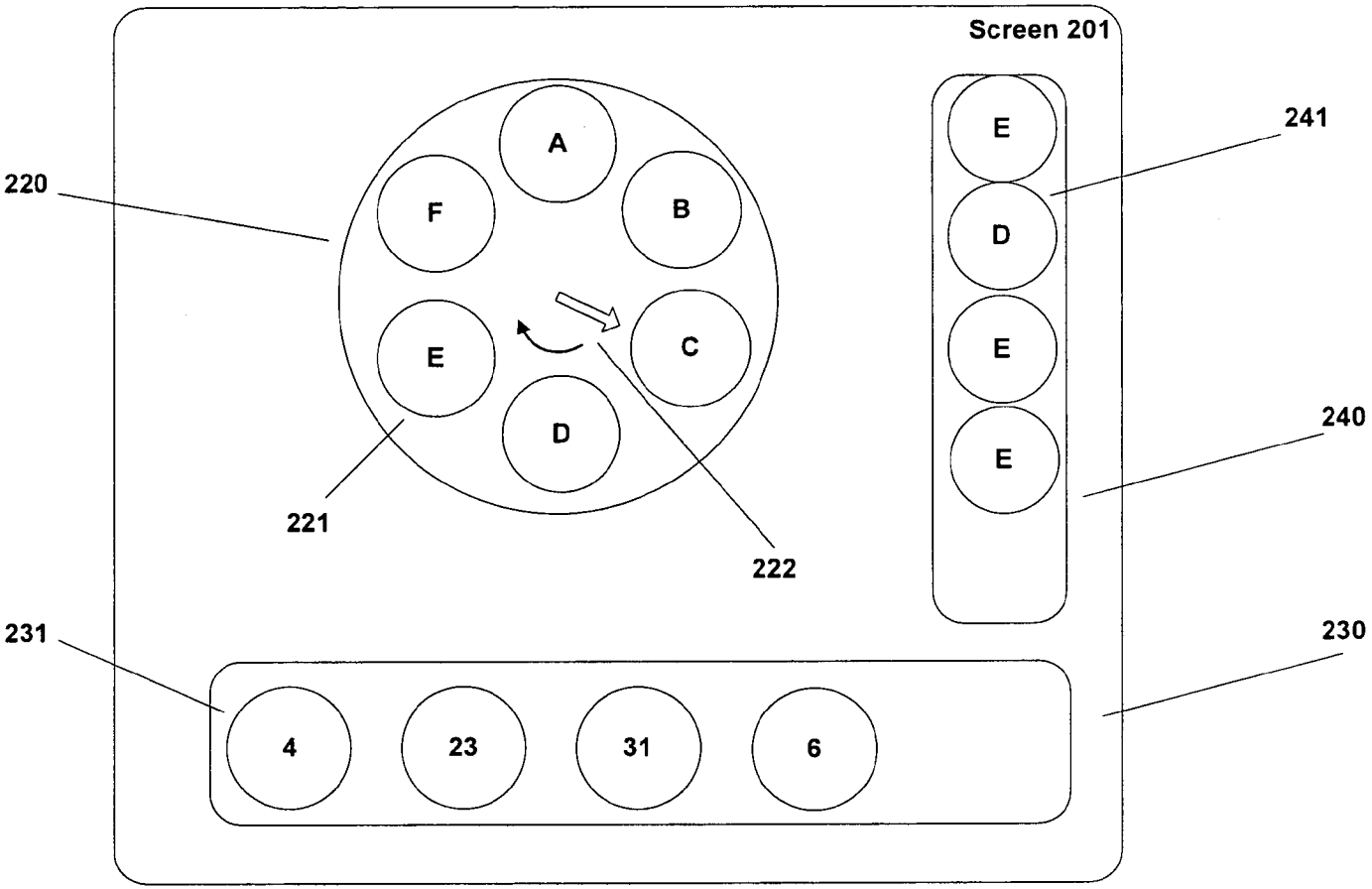
FIG. 3C shows a screen image during a lottery draw in accordance with a modification of the embodiment of FIG. 3A.

In the embodiments of FIGS. 3A and 3B, the cyclic selector in effect removes options corresponding to previously selected lottery balls. For example, once option E has been selected and so has appeared in accumulation block 240, then this option is no longer available within the cyclic selector 220. However, in an alternative embodiment, the option balls can be considered as remaining (or being replaced) in the cyclic selector after selection. Such an embodiment is illustrated in FIG. 3C, which generally operates in the same manner as the embodiment of FIG. 3A, except for the retention of selected options in the cyclic selector. Thus assuming the same sequence of lottery balls as in FIG. 2D, the cyclic selector initially chooses option E as a result of lottery ball 4, as for the embodiment of FIG. 3A. However, the next lottery ball, namely lottery ball 23, now leads to the selection of option D (rather than option B as in FIG. 3A). This difference is caused by the fact that in the embodiment of FIG. 3C, the cyclic selector continues to count option E when performing its rotation. Lottery ball 31 then leads back to the selection of option E in FIG. 3C, while the fourth lottery ball 6 repeats the selection of option E. Hence option E is shown three times in accumulation block 240. It will be appreciated that in contrast, the approach of FIG. 3A does not allow a given option to be accumulated more than once (since previous selections are eliminated from the cyclic selector 220). The replacement strategy of FIG. 3C is particularly appropriate where it makes sense in the context of the game to allow a given option to be selected more than once. For example, if the accumulated options represent digits in a telephone number, it will be appreciated that it is quite possible for a telephone number to contain the same digit twice.

Figure 4A:
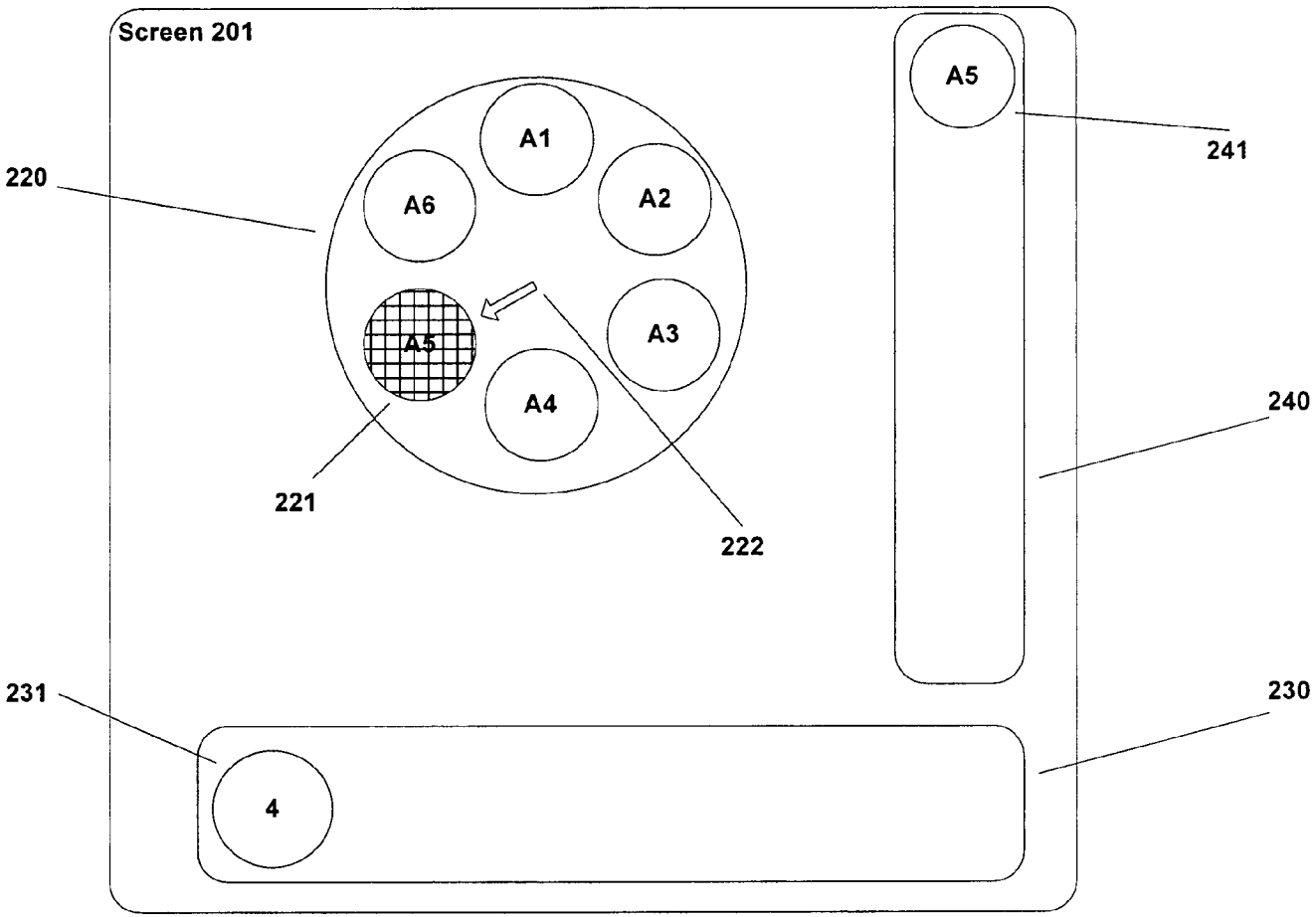
FIGS. 4A-4B show a sequence of screen images during a lottery draw in accordance with another embodiment of the invention.
Figure 4B:
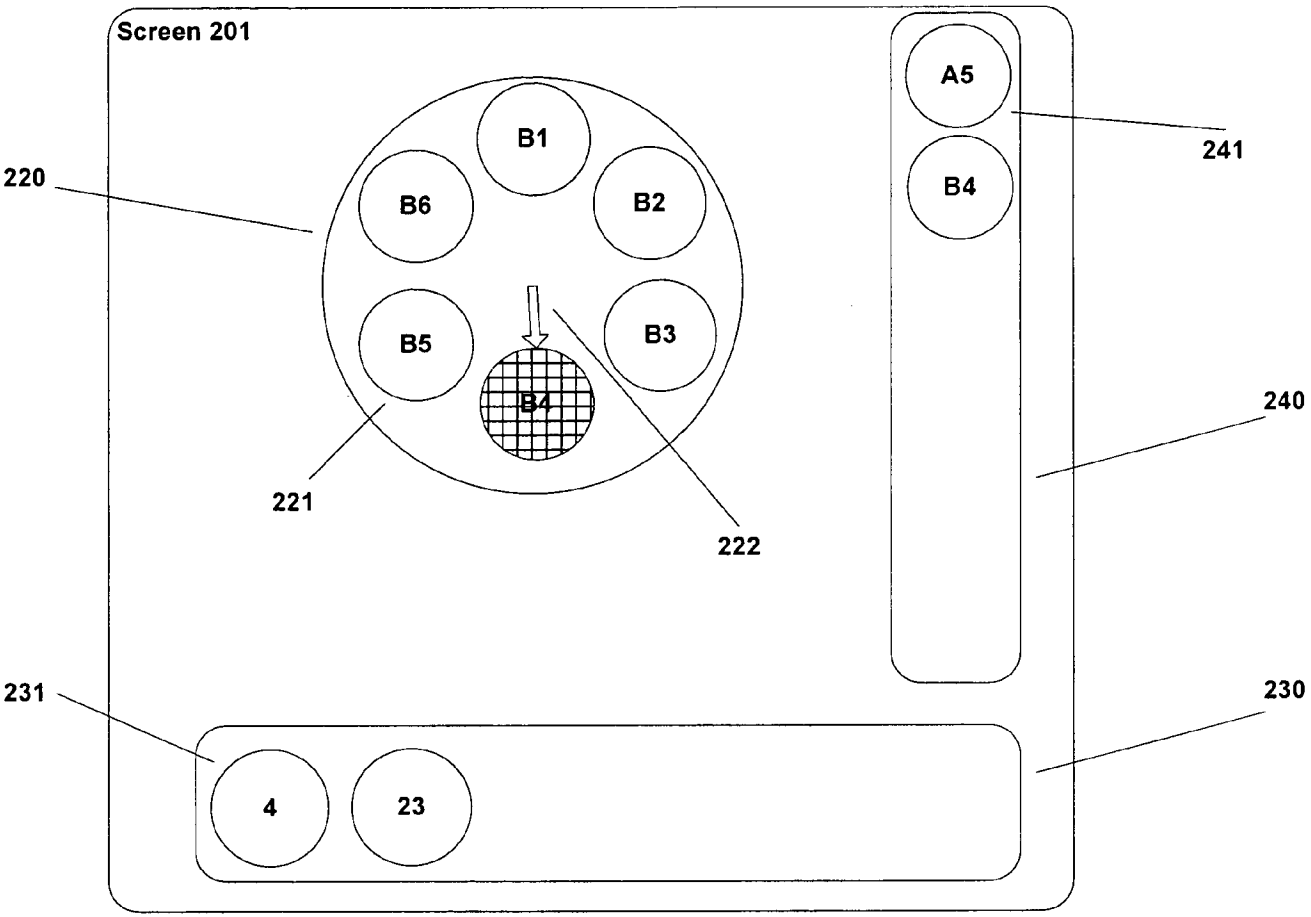

Another possible modification to the embodiment of FIG. 3A is that rather than retaining the same set of options for each lottery ball, an entirely (or partially) new set of options may be provided for each successive lottery ball. For example, FIG. 4A illustrates the situation where the cyclic selector provides options A1, A2, A3, A4, A5 and A6 for the first lottery ball. It is assumed that the first lottery ball drawn is number 4, which therefore results in the selection of option A5 (analogous to the selection of ball E in FIGS. 2A and 2B). For the next lottery ball, a new set of options B1, B2, B3, B4, B5 and B6 is provided in cyclic selector 220. It is assumed that the second lottery ball is 23 (as in FIG. 2B), and starting the rotation from the position corresponding to the previously selected option (i.e. option B5) leads to the selection of option B4. Accordingly, as shown in FIG. 4B, accumulation block 240 now contains (in order) A5 and B4. It will be appreciated that yet further sets of options could be provided for the subsequent lottery balls. Note that although FIGS. 4A and 4B both show the same number of options (six) in each set, the number of options might in fact vary from one set to another (i.e. from one lottery ball to another).

The selection process shown in FIGS. 4A and 4B can be used for a wide range of purposes. For example, the different options might represent categories of people, for example, such as A1 and A2 corresponding to sex (male or female), while options B1, B2, etc may correspond to age by decade, and so on. The first person to ring in who matches all selected categories might then win a prize, or at least be eligible to participate in a competition for such a prize. The different option categories shown in FIGS. 4A and 4B might also represent various sorts of tasks or question categories that a contestant might have to face.

The skilled person will be aware of many possible modifications to the system described so far. For example, with reference to the cyclic selector 220, selection arrow 222 might be stationary, with the options 221 rotating around it (by the appropriate amount). Another possibility is that arrow 222 is omitted altogether and some other mechanism used to illustrate rotation, for example, each of the options 221 around the circumference of cyclic selector 220 may be highlighted in turn. The rotation may also be anti-clockwise rather than clockwise, and the direction of rotation may vary from one lottery ball to another (according to some defined pattern). In addition, although the circular shape of the cyclic selector 220 corresponds well to the nature of the selection process, other shapes or designs may be adopted. For example, the cyclic selector might be modelled as a three-dimensional cylinder, rotating about its axis, and seen from a direction perpendicular to this axis (in this case not all the selection options would be visible at the same time). In addition, the cyclic selector and/or the various options need not be represented by circles, but any other suitable shapes could be employed (which may be different between the different options, for example, squares, stars, and so on).

In some embodiments, the cyclic selector 220 may include a counter and/or a specialised start location. The counter might be positioned in the centre of the selector (or at any other suitable position within screen 201), and count down from the number on the received lottery ball. When the counter reaches zero, this then indicates the selected option. For example, in the configuration of FIG. 2A, the counter would be set to 4 on receipt of ball 231. The counter would then decrement to 3 as arrow 222 moved from ball A to ball B, to 2 as arrow 222 moved from ball B to ball C, to 1 as arrow 222 moved from ball C to ball D, and finally to 0 as arrow 222 moved from ball D to ball E. Such a counter provides a useful visual indicator of when the arrow is about to stop rotating.

A starting position for arrow 222 within cyclic selector 220 may be provided prior to receipt of the first lottery ball 231. This starting position might then be skipped or removed during the counting around the selector. Note that the location of the start position relative to the various options in the cyclic selector might be randomised before the first ball is received (this provides one mechanism to eliminate any initial bias). The use of a special starting option could be repeated for subsequent lottery balls, if so desired (also potentially with randomisation).

A further possible modification is that options that have already been selected, and hence are no longer available for selection (i.e. those shown as hatched in FIGS. 2 and 3) might be removed altogether, with the remaining options then perhaps redistributed evenly around the circumference of the cyclic selector. Another possibility is that there is a separate cyclic selector for each lottery ball, perhaps arranged side by side with one another, or circumferentially within one another.

Figure 5A:
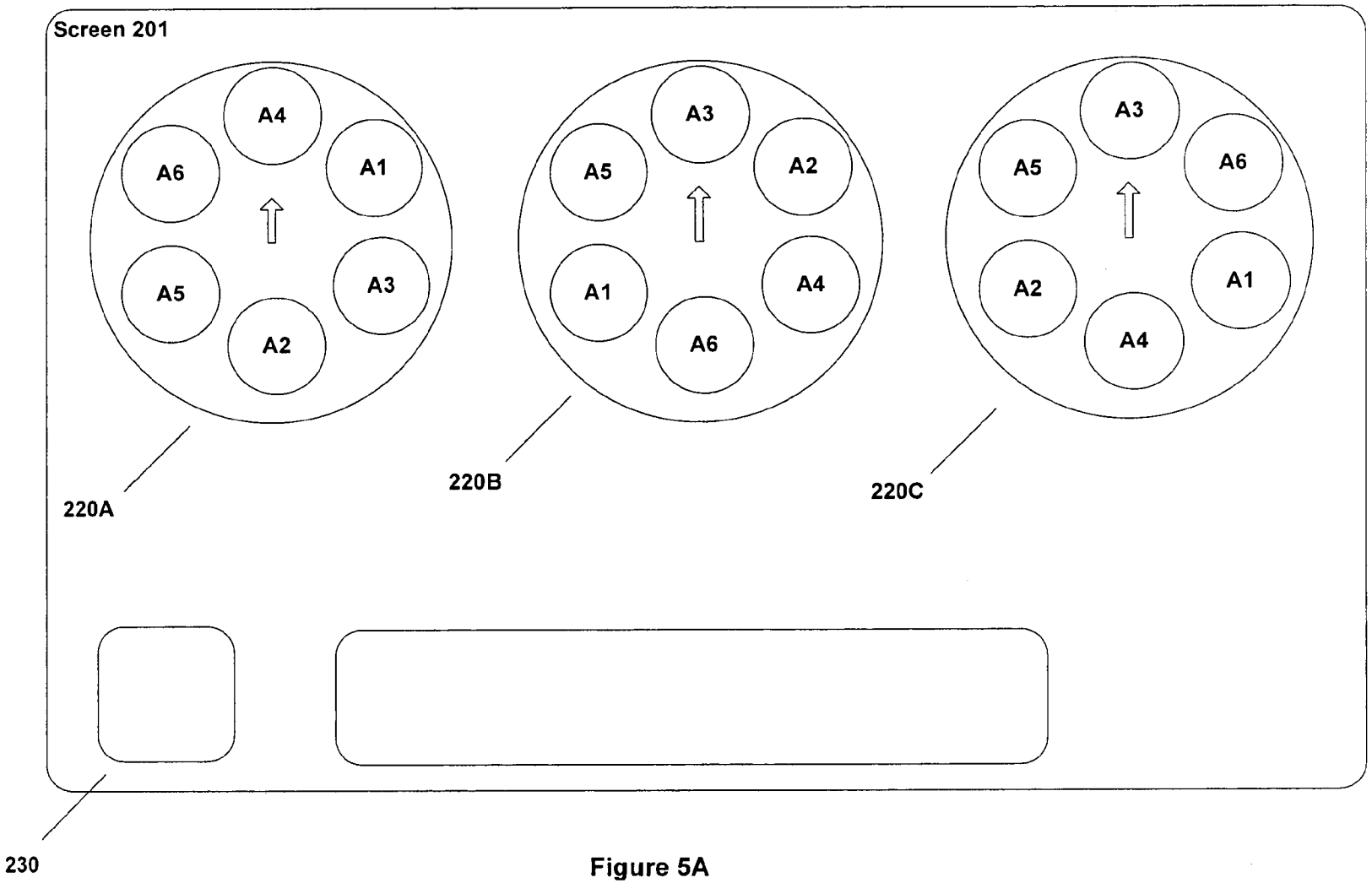
FIGS. 5A-5B show a sequence of screen images during a lottery draw in accordance with another embodiment of the invention.

FIG. 5A illustrates another implementation, this time with multiple cyclic selectors 220A, 220B, 220C. The particular embodiment of FIG. 5A comprises three such cyclic selectors, but in other embodiments, there may be more or fewer cyclic selectors. The multiple cyclic selectors of FIG. 5A are all triggered by a single input number that is received into number panel 230. Note that prior to receiving this input number, the order of the options within the various cyclic selectors 220A, 220B, and 220C is randomised. This avoids all three cyclic selectors producing the same output for a given input. (Another option would be to randomise the starting position of the selection arrow within each cyclic selector).

Figure 5B:
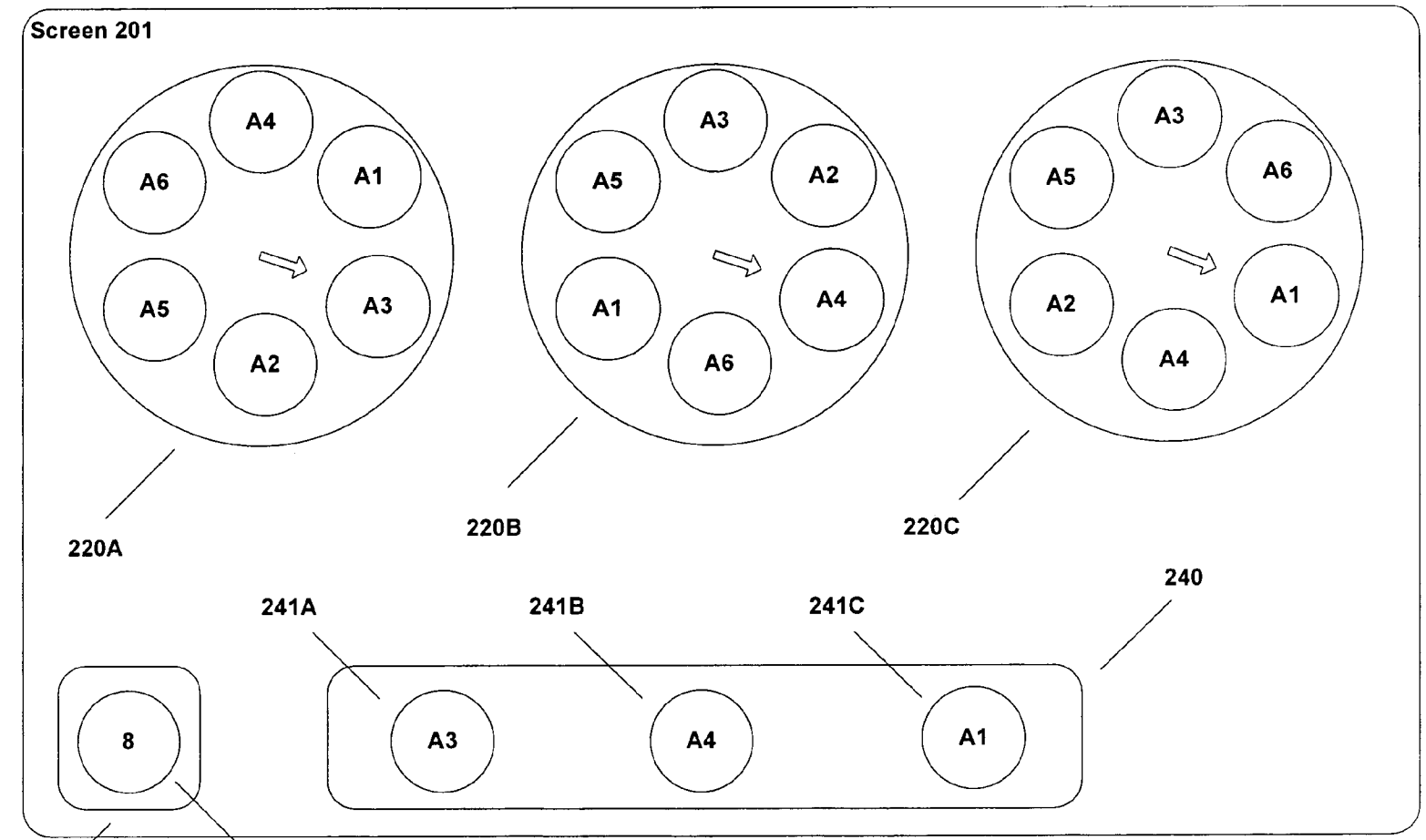

FIG. 5B illustrates screen 201 after an input number 8 has been received, as shown by ball 231 within number panel 230. This input number causes each cyclic selector 220 to operate as previously described, so that for all three cyclic selectors shown in FIG. 5B, the selection arrow has advanced 8 spaces, corresponding to the value of the received number ball 231. This has then produced an output A3 from selector 220A, A4 from selector 220B, and A1 from selector 220C. These outputs are displayed in panel 240, with ball 241A showing the output from selector 220A, ball 241B showing the output from selector 220B, and ball 241C showing the output from selector 220C. The implementation of FIGS. 5A and 5B therefore allows multiple options to be selected from a single input number. This provides improved flexibility in devising games or other material to exploit the cyclic selector 220.

Note that in operation, the selection arrows in the various cyclic selectors 220 of FIG. 5B may all step around in parallel with one another to produce their output substantially simultaneously. Alternatively, each cyclic selector may operate in turn. For example, upon receipt of ball 231, cyclic selector 220A may operate to produce output ball 241A; then cyclic selector 220B may operate to produce output ball 241B; and lastly cyclic selector 220C may operate to produce output ball 241C. Furthermore, although FIGS. 5A and 5B show three identical cyclic selectors, in other implementations, there may be variations between the different cyclic selectors displayed. For example, there may be variations as regards the number and/or type of available options, the configuration and shape of the various cyclic selectors, and so on.

The cyclic selector 220 so far described has been computer-generated. However, a machine implementation could also be constructed, with the selection arrow as a physical device that is spun around to point to different regions of the device corresponding to the different options. Such an implementation may be particularly suited to giving visual impact in a television studio in front of an audience. In addition, although the cyclic selector 220 has been described primarily in the context of television, it could also be employed in other environments, such as the Internet. For example, the sequence of FIGS. 2A-2D could readily be supplied as a graphical animation on a web page. In addition, the Internet could also be used as a transmission medium for a television or other form of video signal. A further possibility is that the sequence of FIGS. 2A-2D might be implemented by an animation downloaded onto a mobile telephone (which can then receive information about the input lottery numbers as they are drawn in order to activate the graphical selector).

In one implementation, the cyclic selector 220 is referred to as a RANDOMAKER™ device, and can be employed in a wide variety of formats and situations, as illustrated by the following examples:

(a) the cyclic selector is based on a number, say 100000. The cyclic selection involves the placing of a comma between the digits of the number, and so in turn determines the amount, e.g. of prize money, for example 1,00000 (=1), 10,0000 (=2), and so on. Alternatively, the selector may be used to determine individual digits of a prize figure. For example, the prize figure may have a total of four digits, so a maximum of 9999, but the selector is used to determine the exact value, one digit at a time, such as by using the accumulation panel shown in FIGS. 3A-3C (the numbers in the accumulation panel corresponding to the digits of the total prize money). A separate selector might also be used to determine the currency in which the prize money is to be obtained.

(b) the selector represents a staircase, with each step corresponding to a prize, where the prizes increase in value towards the top of the staircase. The selection determines the prize to be won. Note that while the selector ascends the staircase one step at a time, it may jump from the top step back to the bottom step. Alternatively, it may reverse direction, and then descend one step at a time.

(c) the selector options are a set of destinations, which may be represented by locations on a globe. The selector is used to select one of the destinations, for example as a prize.

(d) in a memory competition, a set of objects comprises pairs of different items, arranged in random locations. The set of objects is exposed to a player, and then all the objects are obscured. One of the objects is selected by the cyclic selector, and exposed to the player, who in turn has to locate the corresponding item of the pair (which will be currently obscured).

(e) a picture of a famous person (or place, etc) is obscured by a set of panels. The selector is used to select one panel at a time to remove, so that the picture becomes visible at the location of the panel, and a player has to guess the relevant person or place shown in the picture.

(f) a set of blanks is presented corresponding to some name—e.g. of a film, plus the letters in the name in a randomised order (no repeats): for example: --- ------- --- (BENHITL-JAO). The selector is used to pick a letter to fill in, and this continues until the name is guessed or revealed—e.g. after selecting I and T, there would be: T-- IT---I-- --- (The Italian Job).

(g) some initial lottery numbers may be used to populate the cyclic selector with options, with the remaining lottery numbers then being used to make one or more selections. For example, if there are 5 spaces on the cyclic selector, and 8 lottery balls, the first five lottery balls populate the cyclic selector. The remaining three balls can then be used to eliminate three of the first five lottery balls using the cyclic selector. Alternatively, in a lottery draw based on picking 20 balls from 70 possible balls, with a $21^{st}$ ball then being drawn to determine the prize level, a selector with 20 options may be provided, and these are populated in accordance with the 20 lottery balls (in order). The cyclic selector is then used with the $21^{st}$ ball as input to determine a single winning number (from the 20 originally selected). It is assumed here that participants have already selected their number to match beforehand (e.g. by mobile telephone, by purchasing a secondary lottery ticket, etc).

(h) the cyclic selector might be arranged as a spiral format, so that as the selection process steps through the options, there is a general progression towards (or away from) the centre of the spiral. This can then be used to denote some increasing or decreasing facet of the selection process—for example, selection options nearer to the centre of the spiral might correspond to more valuable prizes.

(i) the cyclic selector might be multi-layered. Thus as any given option is selected, this reveals the option corresponding to the layer below, which now becomes available for future selection. The depth of the layer reached may again denote some increasing or decreasing property, such as the degree of difficulty of a quiz question associated with options from that layer. Such an approach may be applied, for example, to game (e) described above, where the cyclic selector is used in relation to a photograph, and each output option corresponds to a region of the photograph. Rather than simply uncovering or exposing a region of the photograph when the corresponding output option is selected, the different option layers may make it increasingly easy to view the region concerned. For example, each time an option layer for a particular region is selected, the number of pixels used to represent that portion of the photograph may double (until full resolution is achieved).

(j) the cyclic selector might comprise multiple concentric rings. The different rings may all have the same set of options, or more options may be available as you progress outwards through the rings (given that there is more space on the outer rings). Each option may correspond to a number in a secondary lottery game, with the order of the options initially randomised for each ring. An input number can be provided for each ring in turn, and transformed into a corresponding output number by counting around the ring. Note that the same input number may be used for all the rings, or each ring may instead have its own input number.

(k) a single screen may comprise multiple selectors, which can all be activated by one input number (as show in FIGS. 5A and 5B). One possibility is that the multiple selectors operate in parallel, and all rotate by the same input number. In another arrangement, the selectors are cascaded, so that the first receives the lottery input number. The output from the first selector in response to the lottery input number is then used as the input to the second selector. The output from the second selector may then be used as the input to the third selector (if present), and so on.

One application of the selector is as part of a second chance lottery game. This may be implemented using the general approach set out using FIGS. 3A and 3B above. In one particular embodiment, the N available selector options represent the set of available lottery numbers. For example, in the UK national lottery, which is drawn from balls 1 through 49, the selector options would then likewise comprise 1 through 49. The ordering of these N=49 options is randomised or shuffled prior to the lottery draw itself. If the lottery draw produces K numbers (K=6 in the UK national lottery), the selector generates another (random) set of K numbers that can be used as the basis for a second chance game. In particular, there may be a predefined starting position on the selector. As each ball is drawn from the main (primary) lottery, the selector counts round from this starting position to determine a corresponding output option. Once an option has been selected for output, it is visually marked to indicate that it is no longer available for selection in respect of additional inputs. Accordingly, the number of options available for selection corresponds to the number of balls remaining in the main lottery draw. Nevertheless, those options that are already selected are still counted when the selector steps through the various possible output options (so that the total number of options available for counting corresponds to the number of balls available at the start of the lottery draw). Such a configuration ensures that no number can be selected twice, and that each (remaining) option has an equal chance of being selected next.

A lottery ticket having a set of numbers for the primary lottery draw can then also be used in this second chance game (participation in the second chance game may be automatic, or potentially subject to some extra payment at the time of purchase of the lottery ticket). Therefore, even if the set of numbers on a lottery ticket is unsuccessful in the main draw, the same set of numbers might prove successful in the second chance game.

The operation of the selector for the second chance lottery game may be interspersed with the main lottery draw itself; in other words, the selector determines a second chance number for each incoming number from the main lottery draw. Alternatively, the operation of the selector may be delayed until the complete set of numbers from the main lottery draw has been completed (this may be simpler to arrange, and less confusing for participants).

Figure 6:
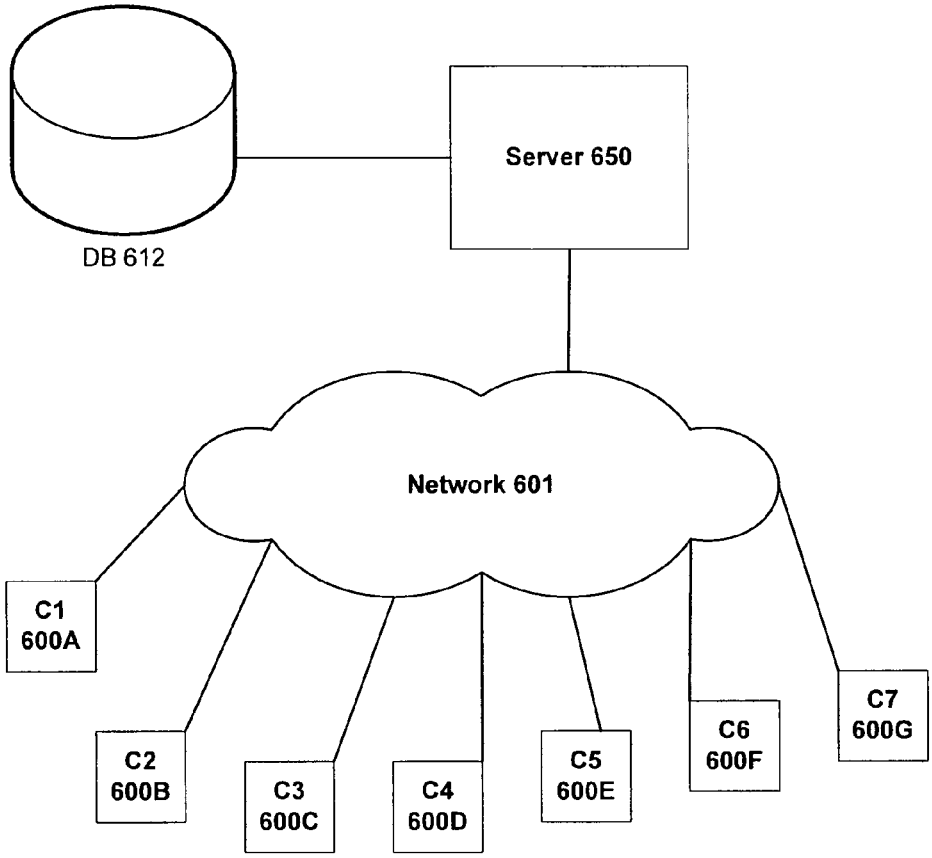
FIG. 6 illustrates in a generic form a system architecture for implementing the invention.

FIG. 6 is a generic diagram of a distributed system which may be used to implement various embodiments of the invention. The system includes a server 650 which is linked to a database 612. The server is further linked to a plurality of clients 600A, 600B, 600C, 600D, 600E, 600F, 600G by network 601. Network 601 may represent a computer network, such as the Internet, a mobile telephone network, a television network (digital, satellite, cable, etc), or any other appropriate wired and/or wireless data communications facility.

Server 650 may be linked to the network 601 via any suitable device. For example, if network 601 represents the Internet, then a web server (not shown in FIG. 6) may be interposed as required between server 650 and network 601. Likewise, if network 601 comprises a mobile telephone network, then server 650 may communicate with clients 600 via the network 601 using appropriate transmission and reception facilities.

Server 650 may be implemented with any suitable computer or combination of computers. Clients 600 may likewise be implemented using any suitable device with network connectivity and some graphical display facility, for example a personal computer, a laptop, a personal digital assistant (PDA), a workstation, a digital television set, a mobile (cellular) telephone, and so on. The clients may be pre-configured with appropriate software, or may download the appropriate software from the network 601, whether from server 650 or some other system. In some embodiments, server 650 may provide clients 600 with a Java applet or similar form of network program (Java is a trademark of Sun Microsystems Inc). Note that while FIG. 6 depicts seven clients linked to server 650, the number of clients so connected may be much higher—potentially hundreds, thousands, or millions.

A variety of clients 600 may be connected to server 650 over one or more different types of network. For example, clients C1, C2, C5 and C6 may be mobile telephones linked to server 650 over a mobile telephone network; clients C3 and C4 may be computer workstations linked to server 650 via the Internet; and client C7 may be a digital television set linked to server 650 via television broadcast (for downstream from server 650 to client C7) and via a telephone network, if required, for upstream from client C7 to server 650.

In some embodiments, server 650 may operate in conjunction with a TV service to clients 600 representing television sets, such as described above in relation to FIGS. 1A and 1B. In another embodiment, network 601 may correspond to a mobile telephone network, and server 650 may provide some sort of lottery service to clients 600 representing mobile telephones. In another embodiment, network 601 may correspond to a computer network, and server 650 may provide some sort of lottery service to clients 600 representing computer workstations.

One possible implementation over network 601 is where clients 600 contact server 650 to participate in a game, such as a secondary game. This may require some form of payment from the client to the service provider, for example as part of a call charge on a mobile telephone. The server may use a standard selector for all players in the secondary game, or at least some players may be provided with their own selectors. In some implementations, the server may randomise the order of the selector before downloading to a requesting client. The server 650 then maintains records in database 612 of the ordering of the selector transmitted to a given client. One or more input numbers are subsequently provided to the client. For example, a user may be watching the lottery on television, and enter the numbers from the lottery draw into the selector on his or her client 600. In other implementations, the lottery numbers might be automatically provided to client 600 by server 650 over network 601.

The output of the selector on the client 600 determines whether or not the client wins, according to some predetermined set of rules. Note that this determination may be absolute, i.e. based purely on the output for that particular client, or may be relative, i.e. in comparison with the results from other clients. As an example of the latter approach, if there are six lottery numbers and the selectors produce six corresponding output numbers, the client who has the lowest total of output numbers (out of all the participating clients) may be declared the winner.

It will be appreciated in some embodiments, the selector is not downloaded onto client 600, rather client is simply used to access server 650. For example, once a participant has used client 600 to enter the game, and to specify his or her selector if desired (see below), the determination of the outcome can be made by server 650 based on the information stored in database 612. The outcome of the game, and the animation of the selector, can then be provided to the client 600 when the client next contacts the server.

In some implementations of secondary games, a player may be able to configure the selector to his or her desired ordering. For example, if there is a lottery game having N options and drawing K balls, with a corresponding secondary lottery game using the selector, then on entering the secondary lottery game, a player may be able to specify their own desired ordering for the selector options. The specified order is then stored in server 650 prior to the lottery draw itself to allow subsequent verification of any win. Such ordering of the selector might be performed, for example, via a given web-site, or using a mobile telephone or digital television service. After the lottery draw, a participant can then revisit the relevant web-site (or access a mobile telephone or digital television service) to view the outcome from his or her specified selector, based on the input numbers from the lottery draw. There may be some charge associated with the ability to re-order a selector, which may be collected via the web-site, as a telephone charge, as part of the purchase cost of an initial lottery ticket, and so on.

The selectors may be useful in bars and other similar venues that provide some form of lottery entertainment such as Keno. For example, in some countries it is common for bars to provide television monitors where lottery draws are displayed on a regular basis (perhaps every ten minutes). People attending the bar can then purchase game cards to participate in the draw(s). In such a configuration, one or more cyclic selectors may be presented on the television monitors to provide additional win opportunities for participants.

In another implementation, the selectors may be useful in video lottery terminals (VLTs). VLTs are similar to slot machines, and are often found in casinos and other entertainment venues. As an example of such a configuration, clients 600 might then represent individual VLTs, and each VLT could be provided with its own selector. The server 650 would then supply a random input, akin to a lottery number, to the VLTs, and each player would win or not win depending upon the output from the selector on their VLT. For example, producing a predetermined output (e.g. 0) from the selector might represent a winning result. In other embodiments, the server 650 might compare the outputs from the different VLTs using network 601 to determine a winning VLT.

In conclusion, a variety of particular embodiments have been described in detail herein, but it will be appreciated that this is by way of exemplification only. The skilled person will be aware of many further potential modifications and adaptations that fall within the scope of the claims and their equivalents.

The invention claimed is:

1. A method of generating a computerised graphic comprising:

receiving a non-predictable number, K, wherein said non-predictable number K comprises a lottery number from a primary game; and outputting a graphical selector comprising N options, wherein said graphical selector randomises the order of the N options within said graphical selector prior to receipt of the input number, and wherein said graphical selector steps in sequence through said N options in accordance with the received number K to select one of said N options, thereby transforming the non-predictable input number K into a selection of an output option for use in a secondary game.

2. The method of claim 1, wherein said secondary game comprises a second chance lottery game.

3. The method of claim 2, wherein N equals the maximum possible value of K.

4. The method of claim 1, wherein said primary game comprises Keno, and wherein said method further comprises presenting the graphical selector on a Keno television monitor.

* * * * *